United States Patent [19]

Soligno

[11] 4,036,461

[45] July 19, 1977

[54] SUPPORTING GRID FOR PIPES

[75] Inventor: Vincenzo Soligno, Milan, Italy

[73] Assignee: Breda Termomeccanica S.P.A., Milan, Italy

[21] Appl. No.: 624,475

[22] Filed: Oct. 21, 1975

Related U.S. Application Data

[63] Continuation of Ser. No. 456,223, March 19, 1974, abandoned.

[51] Int. Cl.[2] ..... F28F 9/00

[52] U.S. Cl. ..... 248/68 R; 52/664; 165/162

[58] Field of Search ..... 165/162, 82; 122/510; 52/664, 666, 668; 176/76, 78; 248/68 R; 403/218, 170, 174

[56] References Cited

U.S. PATENT DOCUMENTS

| | | | |
|---|---|---|---|
| 2,607,455 | 8/1952 | Yellin | 52/664 |
| 3,185,632 | 5/1965 | Bradley | 176/78 X |
| 3,281,328 | 10/1966 | Hazel et al. | 176/76 X |
| 3,660,233 | 5/1972 | Dalke et al. | 176/78 X |
| 3,719,560 | 3/1973 | Mayers et al. | 176/76 X |
| 3,764,471 | 10/1973 | Ripley | 176/78 |
| 3,804,354 | 4/1974 | Weiss | 176/76 X |
| 3,824,153 | 7/1974 | Leaver et al. | 176/78 |
| 3,907,031 | 9/1975 | Tegethoff | 165/162 |
| 3,941,188 | 3/1976 | Scheidl | 165/162 |

FOREIGN PATENT DOCUMENTS

| | | | |
|---|---|---|---|
| 1,083,938 | 1/1955 | France | 52/664 |
| 319,224 | 3/1920 | Germany | 52/664 |
| 1,751,179 | 12/1971 | Germany | |
| 2,035,011 | 2/1971 | Germany | |
| 2,262,621 | 7/1974 | Germany | |
| 2,263,056 | 7/1974 | Germany | |
| 359,274 | 2/1962 | Switzerland | 52/664 |
| 1,223,045 | 2/1971 | United Kingdom | 248/68 R |
| 1,126,733 | 9/1968 | United Kingdom | 176/78 |

*Primary Examiner*—Roy D. Frazier
*Assistant Examiner*—Rodney H. Bonck
*Attorney, Agent, or Firm*—Fleit & Jacobson

[57] ABSTRACT

The invention refers to a supporting grid for pipes particularly in steam generators, heat exchanger and other thermic apparatus.

This supporting grid is formed of a plurality of intersecting strips forming a reticular structure joined to a peripheral frame, characterized by the fact that the connection between the strips and the peripheral frame is made by means of precision mechanical fixing joints, which prevents reciprocation of the parts but permits free thermic expansion of the same.

2 Claims, 12 Drawing Figures

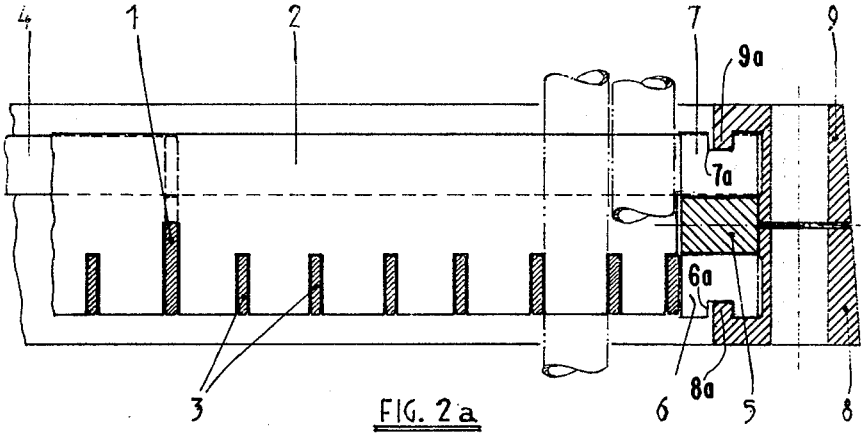
FIG. 2a
FIG. 2b
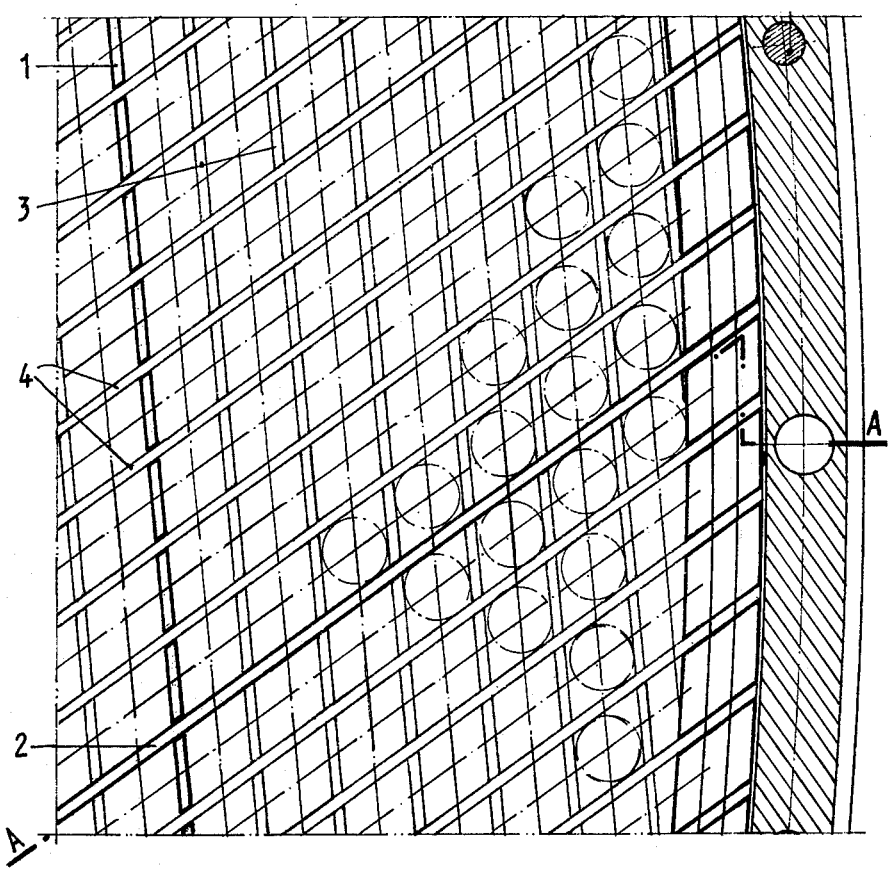

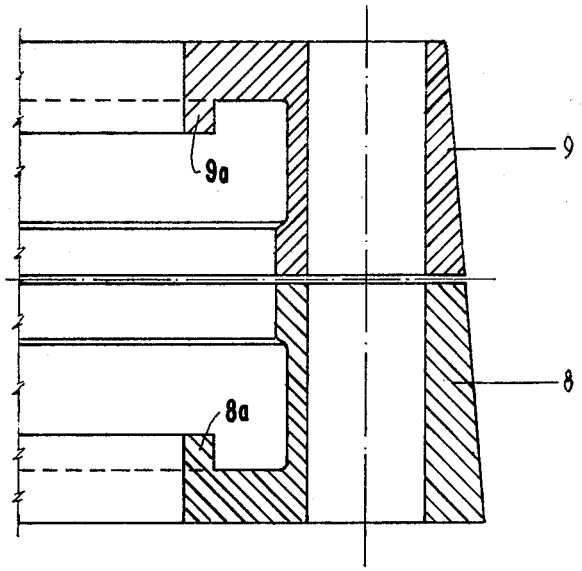
FIG. 4a
FIG. 4b
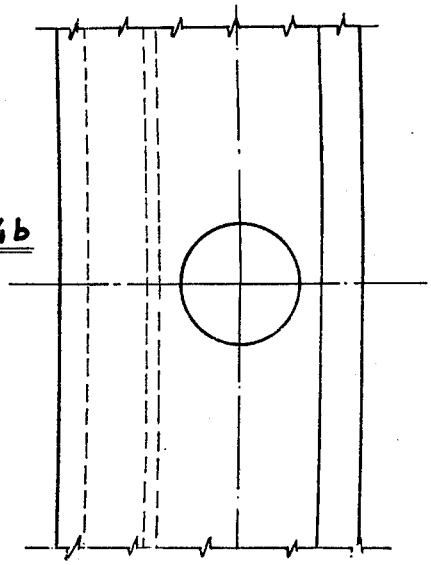

SUPPORTING GRID FOR PIPES

This is a continuation, of application Ser. No. 456,223, filed Mar. 28, 1974, now abandoned.

The object of the present invention is to provide differential thermal expansion mechanical joint between a reticular structure of stainless steel strips and an external annular frame, for example in carbon steel.

The joint between the terminal ends of the strips and the annular frame provides play for the free differential thermic expansion between the above mentioned materials.

Between the terminal ends of the strips, gauged carbon steel spacers are inserted.

The coupling to one another of the strips is of the comb type, with milled slots.

This type of joint, has the following advantages with respect to normal welded joints still used today to form pipe supporting grids.

Expansion of the joint at all working temperatures and consequent long duration of the same.

Precision in the realization of the geometry of the reticular structure, only mechanical and not welding operations being involved during the manufacture.

Simplicity of realization with normal mechanical operations.

Precision in the alignment of several pipe supporting grids, of the type described, having the same geometrical configuration for the reasons described.

Facility and speed in inserting the pipes in the tube plates.

Elimination of damages to the pipes during the inserting operation, caused by the forcing through supports of less precision such as those of the type having welded joints.

Working with steam generators, heat exchangers etc., and long duration of said apparatus.

The object and the advantages of the invention are more clearly illustrated by the description of the following drawings which represent a typical, but not limiting, solution:

FIG. 2 represents in a larger scale a portion of the differential mechanical joint in cross section (FIG. 2*a*), and a partial plan view (FIG. 2*b*);

FIG. 4 represents an enlarged view of a portion of the external annular frame, in cross section (FIG. 4*a*), and a partial plan view (FIG. 4*b*);

Figure 1A:
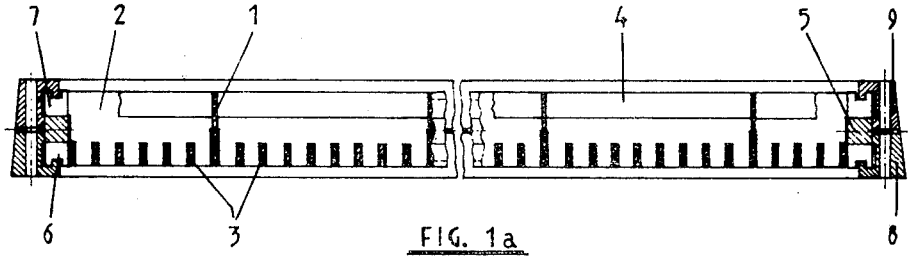
FIG. 1 represents schematically the whole of the supporting grid, in section (FIG. 1*a*) and in a plan view (FIG. 1*b*).

As represented in the drawings (FIG. 1, FIG. 2, FIG. 5) the schematic whole of the pipe supporting grid consists of the following components:

Lower main strips 1 in stainless steel
Upper main strips 2 in stainless steel
Lower secondary strips 3 in stainless steel
Upper secondary strips 4 in stainless steel
Intermediate spacer ring 5 in carbon steel
Lower spacer 6 in carbon steel Upper spacer 7 in carbon steel
Lower external ring 8 in carbon steel
Upper external ring 9 in carbon steel
Joining plug 10 between the rings 8 and 9.

Figure 1B:
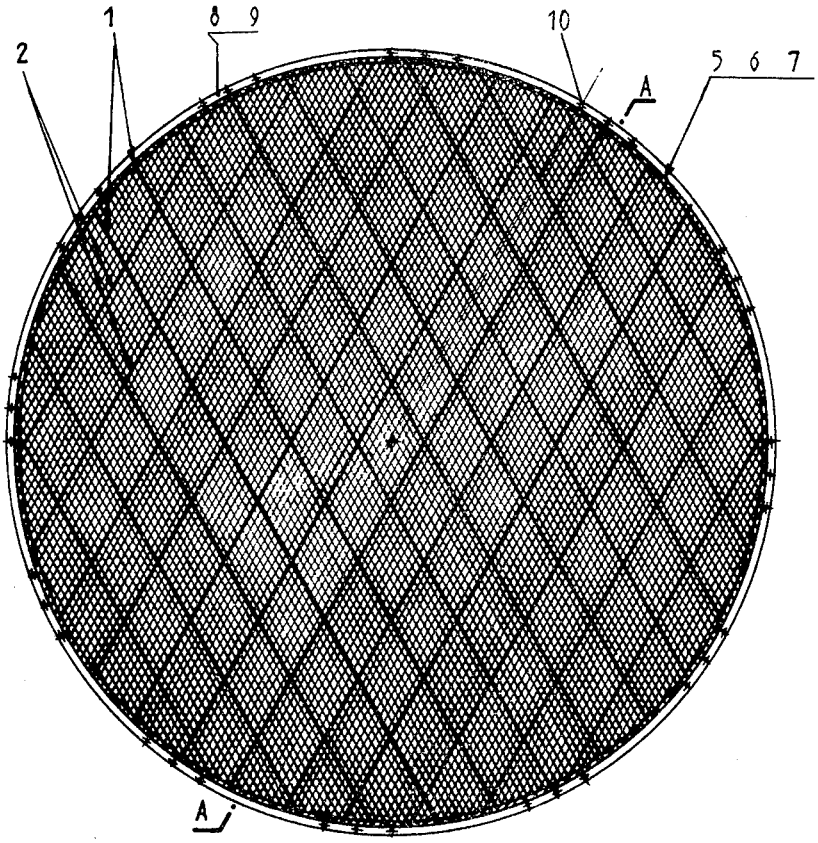

The joining unit, FIG. 2, is made of the same components as for FIG. 1 and therefore bear the same reference numbers.

Figure 3A:
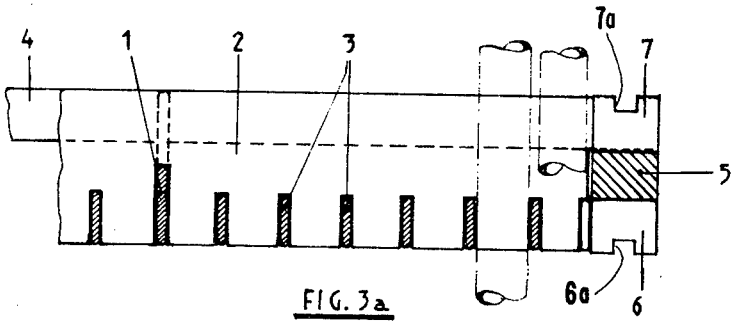
FIG. 3 represents in a larger scale a portion of the reticular structure, in cross section (FIG. 3*a*), partial plan view (FIG. 3*b*), and a side perspective view (FIG. 3*c*)
Figure 3C:
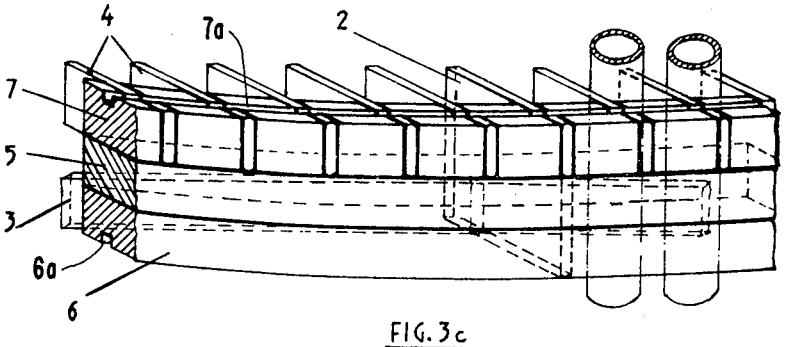
Figure 3B:
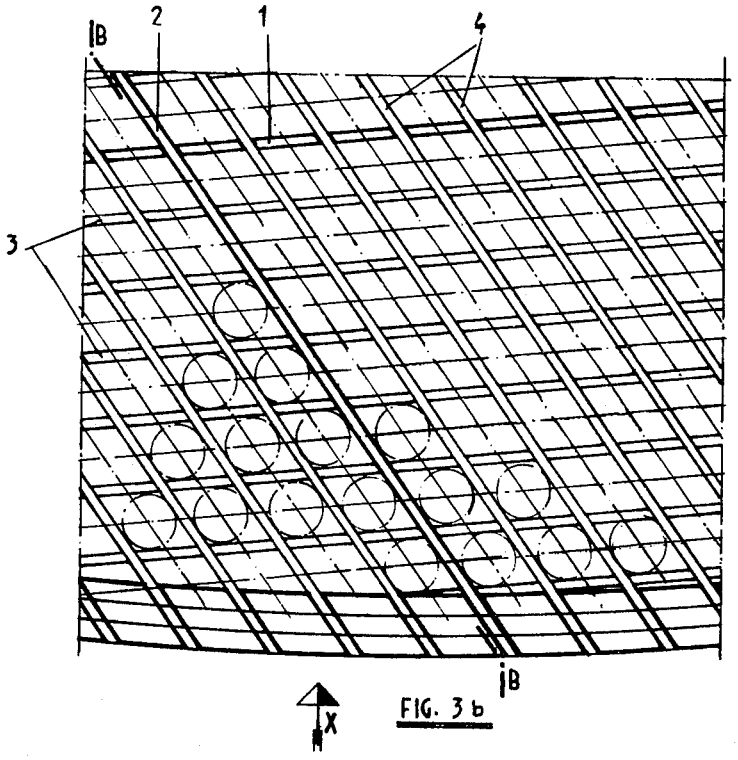

The reticular structure unit, FIG. 3 is made of the components already indicated above and therefore bear the same reference numbers.

The annular frame, FIG. 4, is composed of the lower external ring 8 and upper external ring 9 in carbon steel mentioned above and therefore bears the same reference numbers. FIGS. 3 and 4 illustrates the grooves 6*a* and 7*a* in the spacers 6 and 7 and FIGS. 2 and 4 illustrate the inwardly extending dogs 8*a* and 9*a* in the rings 8 and 9 as well as the relative width of the dogs and grooves and the frusto-conical configuration of the external surface of the frame.

Figure 5:
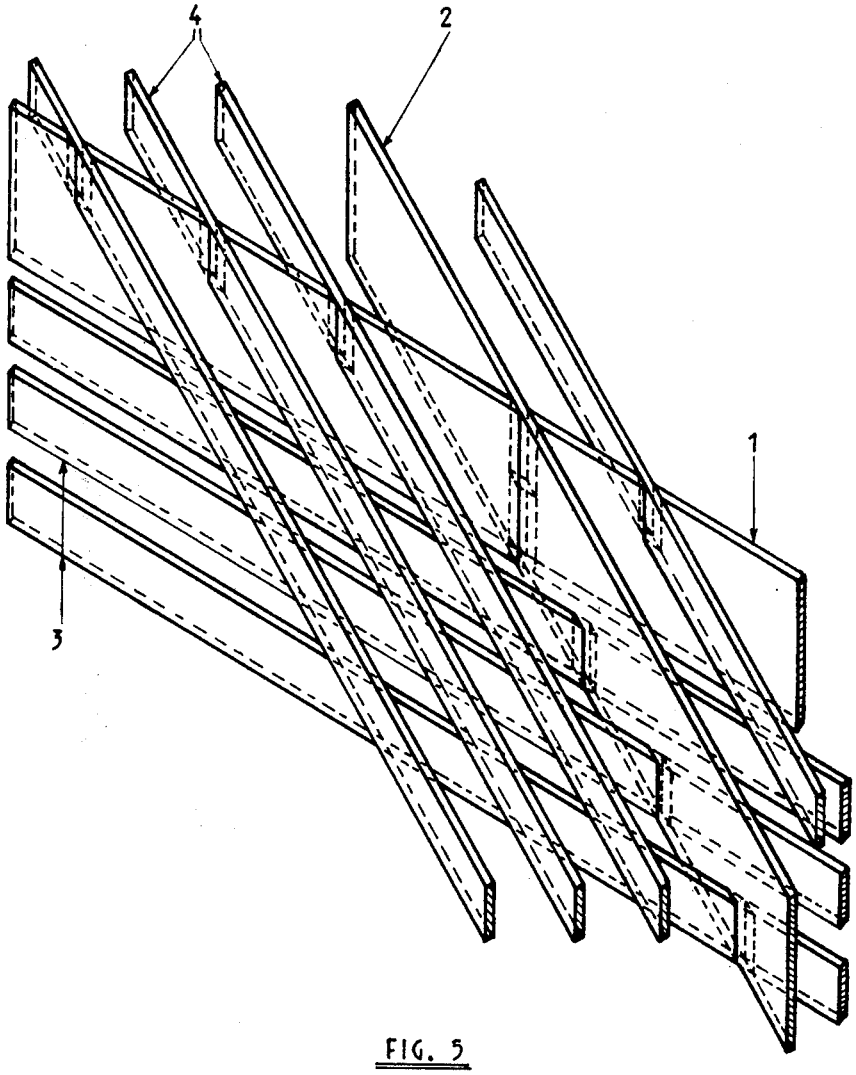
FIG. 5 represents in a perspective view the joining detail between the strips.

FIG. 5 shows the joining details of the main strips 1 and 2 and the secondary strips 3 and 4.

The milled slots of the main strips are of two kings:

Main slots — with a depth equal to half the width of the strip, for the coupling of the main strips to one another.

Secondary slots- with a depth equal to one-third of the width of the strip able to receive the secondary strips.

Figure 7:
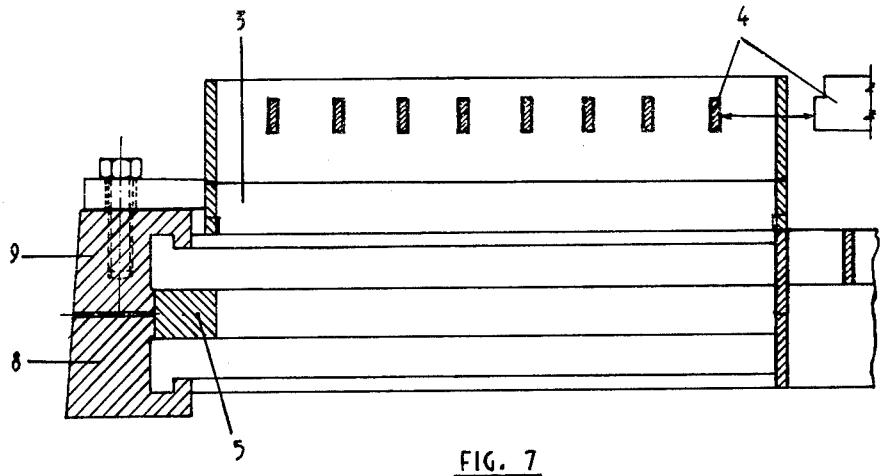
FIGS. 6 and 7 represent schematically a variation of the pipe supporting grid.
Figure 6:
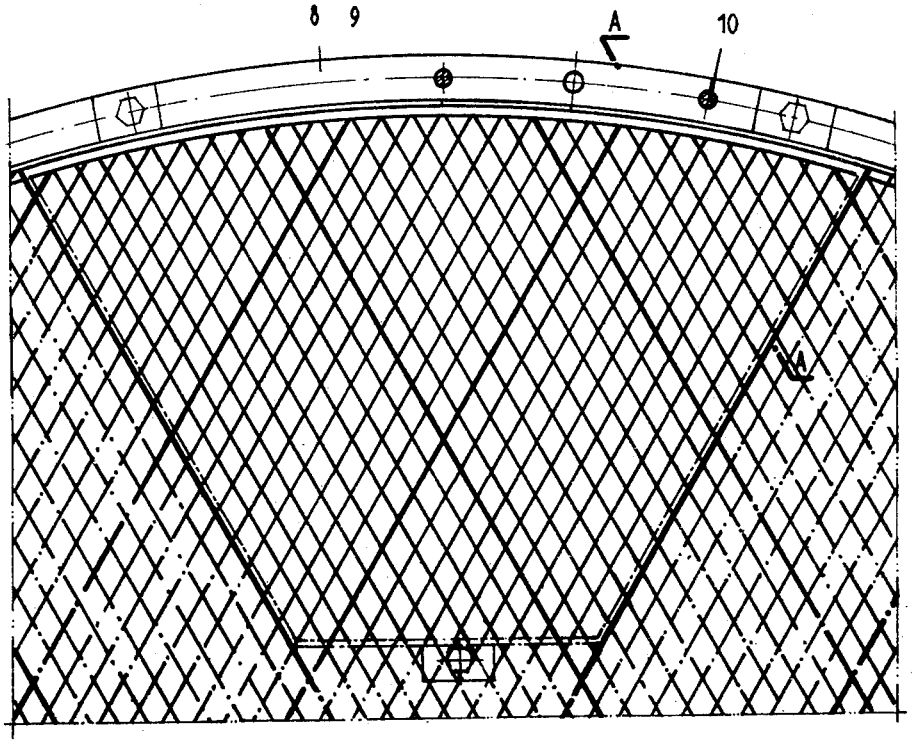

In FIGS. 6 and 7 a variation in the pipe supporting grid is shown in which a manhole is provided in the grid, in a peripheral area, with a cover, indicated in FIG. 6 by a broken and unbroken line.

The coupling of the main and secondary strips with the peripheral elements of the manhole is of the comb type with blind milled slots on the surrounding elements, with play for the free expansion of the strips at all working temperatures. The details of this joining means can be seen in FIG. 7 of the drawing.

The joining between the manhole cover and the grill is of the screw type, with free running at all temperatures.

The reticular structure unit comprising the intermediate ring 5 and the spacers 6 and 7 may also be made of a whole ring of a height equal to the sum of the height of the components 5, 6 and 7. In said ring there are upper and lower slots obtained by milling, for receiving the ends of the main and secondary strips.

The reticular structure unit made up of the intermediate ring 5 and the spacers 6 and 7, may also only be made of the spacers 6 and 7 having an increased height equal to a half of the sum of the heights of the components 5, 6 and 7.

The above described spacers may also have width greater than the thickness of the strip. In said spacers a centre line slot is made by milling to receive the end of a strip. In this case the spacer is mounted astride the strip and is in contact with the successive spacer on the centre line between the end of two contiguous strips.

The unit comprising the components 5, 6 and 7 may also be made of ring segments having a height equal to the sum of the height of the components 5, 6 and 7 and a circumference equal to one-fourth or one-sixth, or one-eighth etc., of the entire circumference.

The slots for receipt of the ends of the main and secondary strips are milled, at the top and bottom of said segments.

The material described above may also be substituted by equivalent material and for each pair of said different materials for the reticular structure and for the outer frame there will be suitable play to allow free differential thermic expansion in the area of the joint.

In the case in which the materials are equal, there may be no play, but it is nevertheless suitable that a minimum amount of play be provided to allow the free thermic expansion of the components of the pipe supporting grid due to the inevitable uneveness in the temperature of the same.

I claim:

1. A supporting grid for pipes comprising:

a. an upper and lower set of intersecting strips having interengaging milled slots at the intersecting points, and b. an external annular frame, said frame being formed of a lower and an upper part of substantially identical configuration, an upper and lower set of block-like spacers positioned between the ends of adjacent strips to substantially fill the peripheral space therebetween, said spacers having opposed, generally radially extending surfaces in surface-to-surface contact with substantial surface areas of the ends of adjacent strips, said strips and said frame being of different materials, said strips being provided at their ends with upper and lower grooves facing axially outwardly and spaced inwardly from the ends thereof, said spacers being provided with upper and lower grooves aligned with the grooves in the strips, said frame having an upper and lower annular flange overlying the surface of the strips and spacers radially outwardly of the grooves and terminating in an annular dog extending axially into said grooves in the strips and spacers, said grooves having a width greater than the dogs thereby providing play between the dogs and grooves to enable differential thermic expansion of the strips and frame, the axially inner surfaces of the spacers and the ends of the strips being aligned and defining axially spaced and substantially continuous annular surfaces, an independent annular ring extending peripherally between the outer ends of the strips and between the upper and lower spacers in engagement with said annular surfaces, and means securing the upper and lower parts of the frame together to enable assembly without deformation and to rigidly secure the grid in assembled condition.

2. A grid according to claim 1, wherein the external surface of the frame is frusto-conical.

* * * * *